US009085347B2

(12) United States Patent
Antonelli

(10) Patent No.: US 9,085,347 B2
(45) Date of Patent: Jul. 21, 2015

(54) HULL STRUCTURE ESPECIALLY FOR RECREATIONAL VESSELS

(76) Inventor: Attilio Antonelli, Fano (IT)

( * ) Notice: Subject to any disclaimer, the term of this patent is extended or adjusted under 35 U.S.C. 154(b) by 85 days.

(21) Appl. No.: 13/809,342

(22) PCT Filed: Jul. 18, 2011

(86) PCT No.: PCT/EP2011/062222

§ 371 (c)(1),
(2), (4) Date: Jan. 16, 2013

(87) PCT Pub. No.: WO2012/010545

PCT Pub. Date: Jan. 26, 2012

(65) Prior Publication Data

US 2013/0112130 A1 May 9, 2013

(30) Foreign Application Priority Data

Jul. 19, 2010 (IT) ..... PS2010A0020

(51) Int. Cl.
*B63B 43/14* (2006.01)
*B63B 7/02* (2006.01)
*B63B 35/73* (2006.01)

(52) U.S. Cl.
CPC . *B63B 43/14* (2013.01); *B63B 7/02* (2013.01); *B63B 35/73* (2013.01)

(58) Field of Classification Search
CPC ..... B63B 1/14; B63B 2001/145; B63B 7/02; B63B 43/14
USPC ..... 114/61.15, 61.18, 123, 284, 85
See application file for complete search history.

(56) References Cited

U.S. PATENT DOCUMENTS

| | | | | |
|---|---|---|---|---|
| 1,710,625 | A | 4/1929 | Kapigian | |
| 3,925,837 | A * | 12/1975 | Miller | 114/352 |
| 5,642,682 | A | 7/1997 | Pierce | |
| 6,003,458 | A | 12/1999 | Valliere | |
| 2002/0033127 | A1 * | 3/2002 | Barrett | 114/61.15 |
| 2005/0034645 | A1 | 2/2005 | Smith | |

FOREIGN PATENT DOCUMENTS

| | | |
|---|---|---|
| FR | 2358314 | 2/1978 |
| FR | 2875781 | 3/2006 |

* cited by examiner

*Primary Examiner* — Edwin Swinehart
(74) *Attorney, Agent, or Firm* — Themis Law

(57) ABSTRACT

A hull structure, especially for recreational vessels, includes at least one insulated bottom element section or moveable bottom element displaceable laterally by means of projecting actuators from a position adhering to the hull and preferably recessed into a respective shape, to at least one position projecting outside of the hull, with respect to which members for widening the deck project therewith in synchronism with the at least one displaced hull section or displaced moveable bottom element and vice versa.

3 Claims, 10 Drawing Sheets

HULL STRUCTURE ESPECIALLY FOR RECREATIONAL VESSELS

DETAILED DESCRIPTION

1. State of the Art

In recreational sailing habitability aspects of the recreational vessels—in particular when the vessel is anchored on the docks and near the coast to allow the occupants to bathe in the sea, sunbathe and convivial contexts, a use condition which, in such kind of vessels, is usually more frequent with respect to sailing which usually ends after a few miles of sailing—play a fundamental role.

2. Objects of the Invention

In this context, the main object of the present invention is to provide a solution concept capable of allowing exploiting a greater manoeuvrability of the vessel especially recreational vessels, while anchored, offshore.

Another object of the present invention is to attain the previous object through a concept solution that does not negatively impact the seaworthiness qualities of the vessel and which however does not jeopardise sailing.

Still another object is that of attaining the previously mentioned objects through a concept solution capable of maintaining low overall dimensions of the vessel at the port anchoring mooring site.

A further object of the present invention is to avoid a negative impact on the safety of the vessel.

Still another object of the present invention is to attain the previously mentioned objects through a concept solution that is simple and efficient, safe during operation and relatively inexpensive considering the results practically attained therewith.

SUMMARY OF THE CONCEPT SOLUTION

These and other objects are attained by means of the hull structure, especially for recreational vessels, according to the present invention, comprising at least one isolated bottom element section (2A, 2B) or moveable bottom element (2A, 2B) displaceable laterally by means of projecting actuators (10, 11, 14, 16, 21, 22) from a trim adhering to the hull (1) and preferably recessed into the respective shape, to at least one trim projecting outside the hull (1) with respect to which means (4A, 4B) for widening the cover (4) project therewith balanced by said at least one displaced hull section (2A, 2B) or displaced moveable bottom element (2A, 2B) and vice versa.

DESCRIPTION OF THE ATTACHED DRAWINGS

Further characteristics and advantages of the hull structure according to the present invention shall be more apparent from the following detailed description of the preferred but non-exclusive embodiments thereof, represented solely by way of non-limiting example in ten attached drawings, wherein.

STATIC DESCRIPTION OF A FIRST EMBODIMENT

Figure 1:
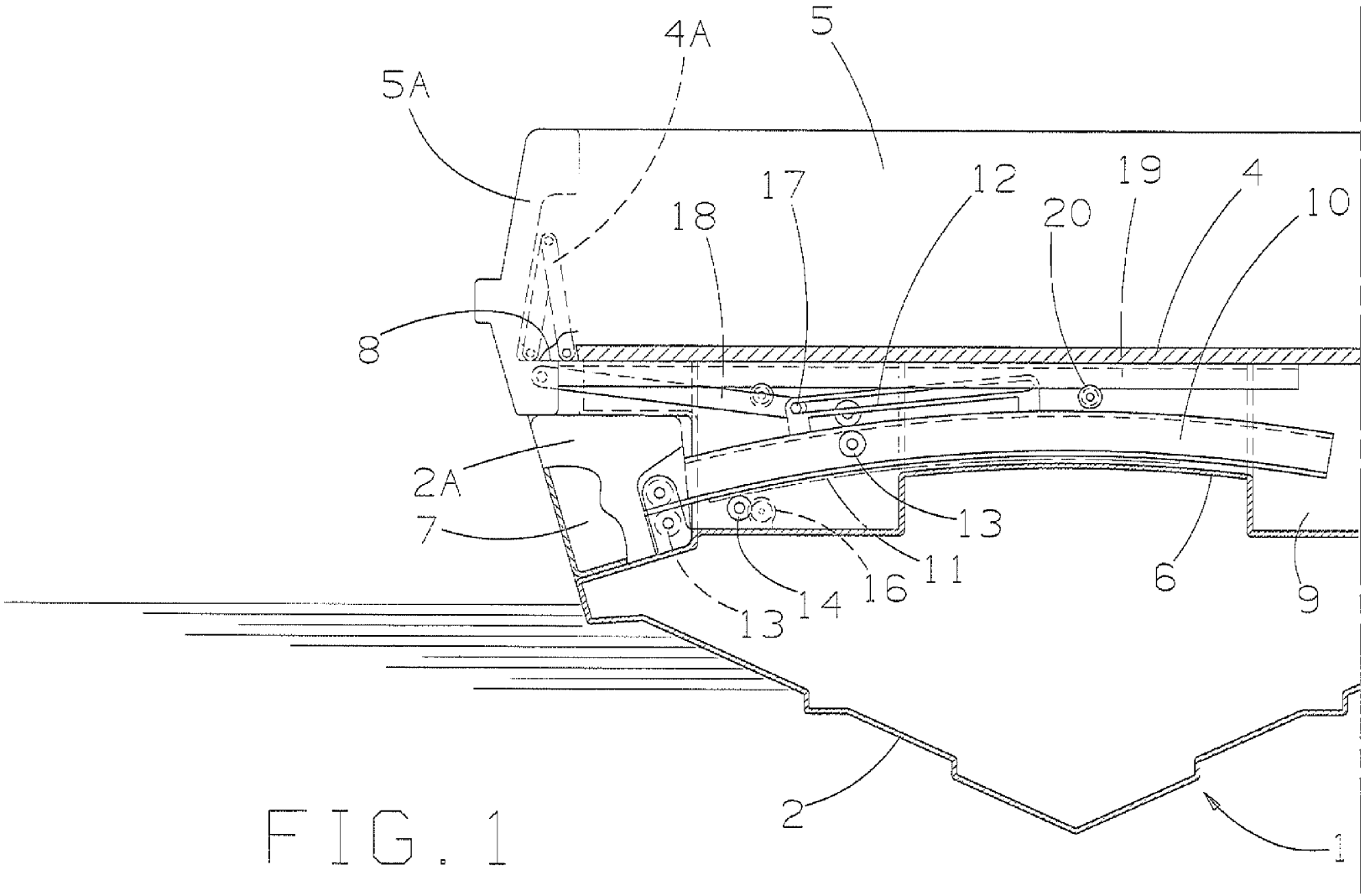
FIGS. 1, 2 and 3 show cross-sectional schematic views of a recreational vessel, provided with the hull structure according to the present invention, in a first exemplifying embodiment thereof, represented in an equivalent number of operative configurations.

With reference to such figures, in the figures numbered from 1 to 5, there is illustrated a first alternative embodiment of the hull structure according to the present invention, where 1 is used to indicate the hull, 2 is used to indicate the bottom element closed by a shaped airtight bridge 6, 3 is used to indicate the top side, 4 is used to indicate the cover and 5 is used to indicate the plankings or gunwales.

On the two sides of the hull 1 there are respectively defined longitudinal bottom sections 2A, hereinafter also referred to as "moveable bottom elements 2A", or "ejectable bottom elements 2A", with airtight interior 7.

Above the moveable bottom elements 2A there are provided planking sections 5A, dimensioned with length substantially corresponding to the extension of the underlying moveable bottom elements 2A, insulated from the cover 4 by means of respective interruptions 8.

The moveable bottom elements 2A recede into a shape of the hull 1, contingently housed, without projecting, in respective complementary compartments 9, provided on the two sides of the hull 1 (in particular see FIG. 1).

The moveable bottom elements 2A are internally constrained to the apices of a respective pair of sectioned curvilinear beams 10, housed between the bridge 6 and the cover 4, provided at the lower part with respective racks 11 and above with respective symmetric pairs of slots 12, which develop parallel to the curvilinear beam of respective reference over a relative longitudinal section.

Figure 4:
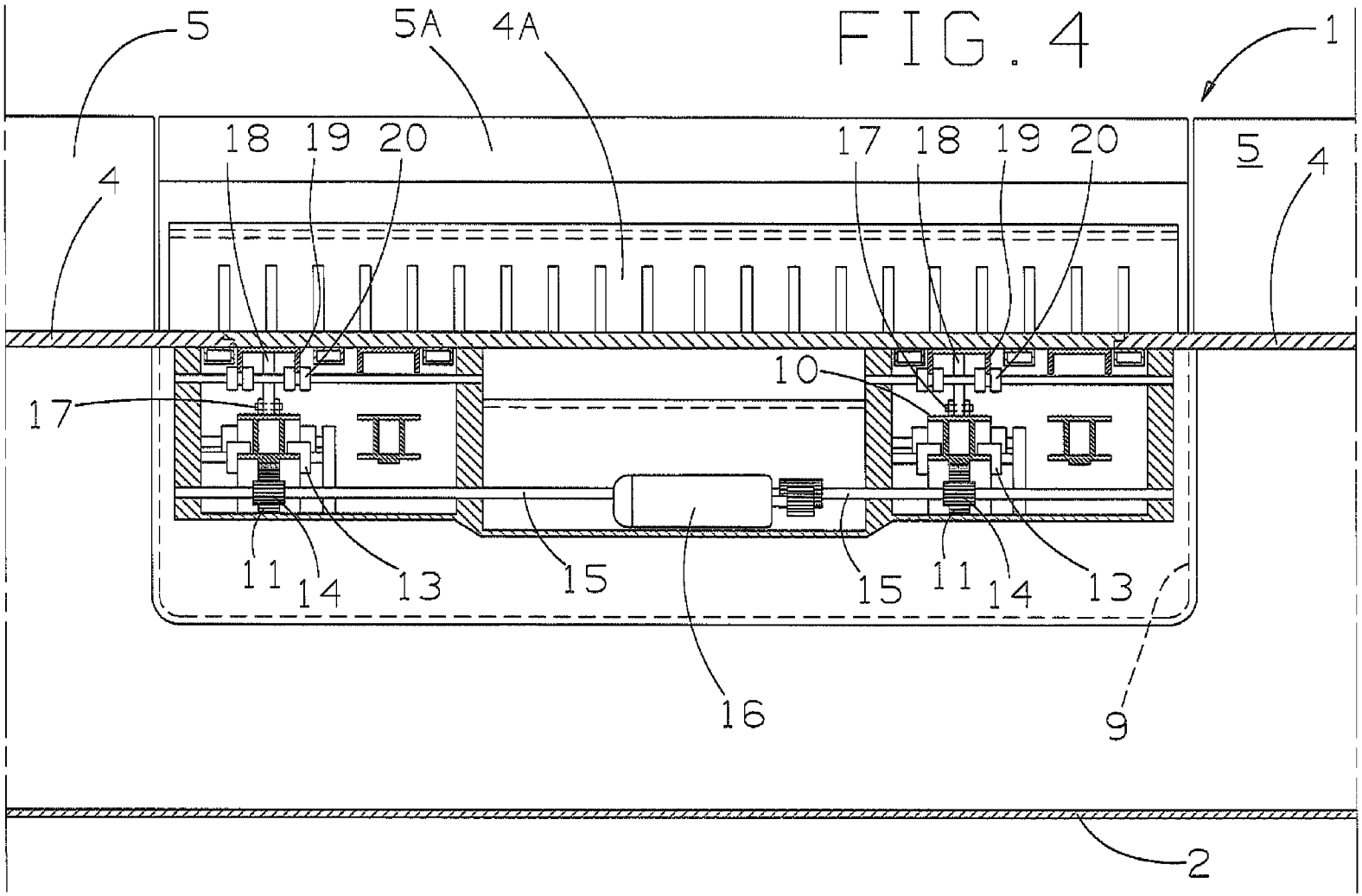
FIG. 4 shows a longitudinal section schematic view of a portion of a recreational vessel, provided with the hull structure according to the present invention, in a first exemplifying embodiment thereof.
Figure 5:
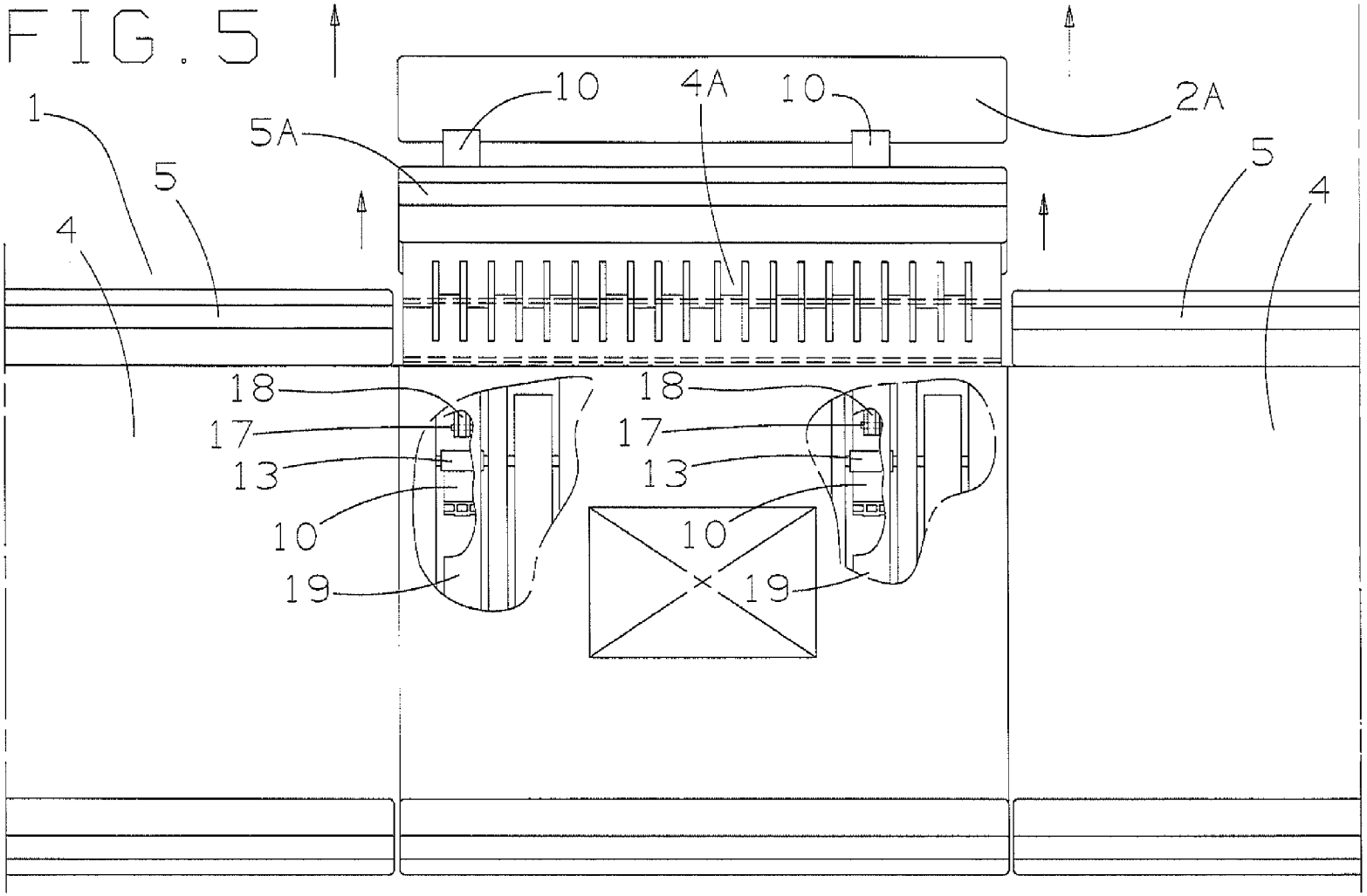
FIG. 5 shows a flat section schematic view of a portion of a recreational vessel provided with the hull structure according to the present invention, in a first exemplifying embodiment thereof.

The curvilinear beams 10, withheld by guide rollers 13, can be ejected and retracted by means of pinions 14, engaged in the racks 11 and connected, by means of shafts 15, to electric motorisations 16 (also see FIG. 4).

Within the symmetric pairs of slots 12 of the curvilinear beams 11 there are engaged pins 17 at the foot of connecting rods 18, which are constrained apically at the other end at the head of the planking or gunwale sections 5A, in turn integral with sectioned rectilinear beams 19, sliding beneath the cover 4 on guide rollers 20.

At the ends of the interruptions 8, there is constrained a bellow panel 4A, hereinafter also referred to as "cover extension" and also distinguished with reference 4A.

All the described structures are symmetrically conceived on the two sides of the hull 1.

STATIC DESCRIPTION OF A SECOND EMBODIMENT

Figure 6:
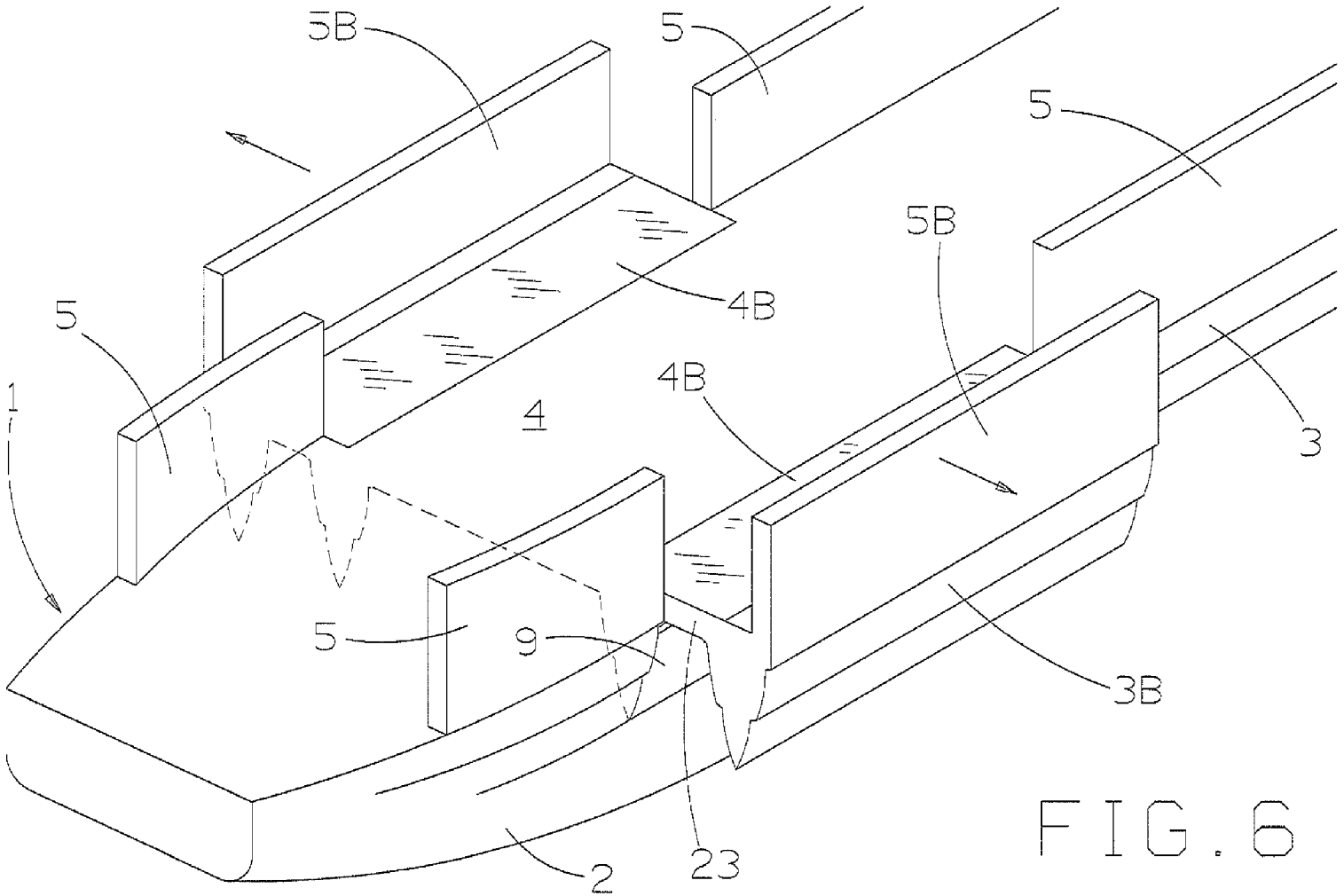
FIGS. 6 and 7 show perspective views of a portion of a recreational vessel, provided with the hull structure according to the present invention, in a second exemplifying embodiment thereof, represented in an equivalent number of operative configurations.
Figure 7:
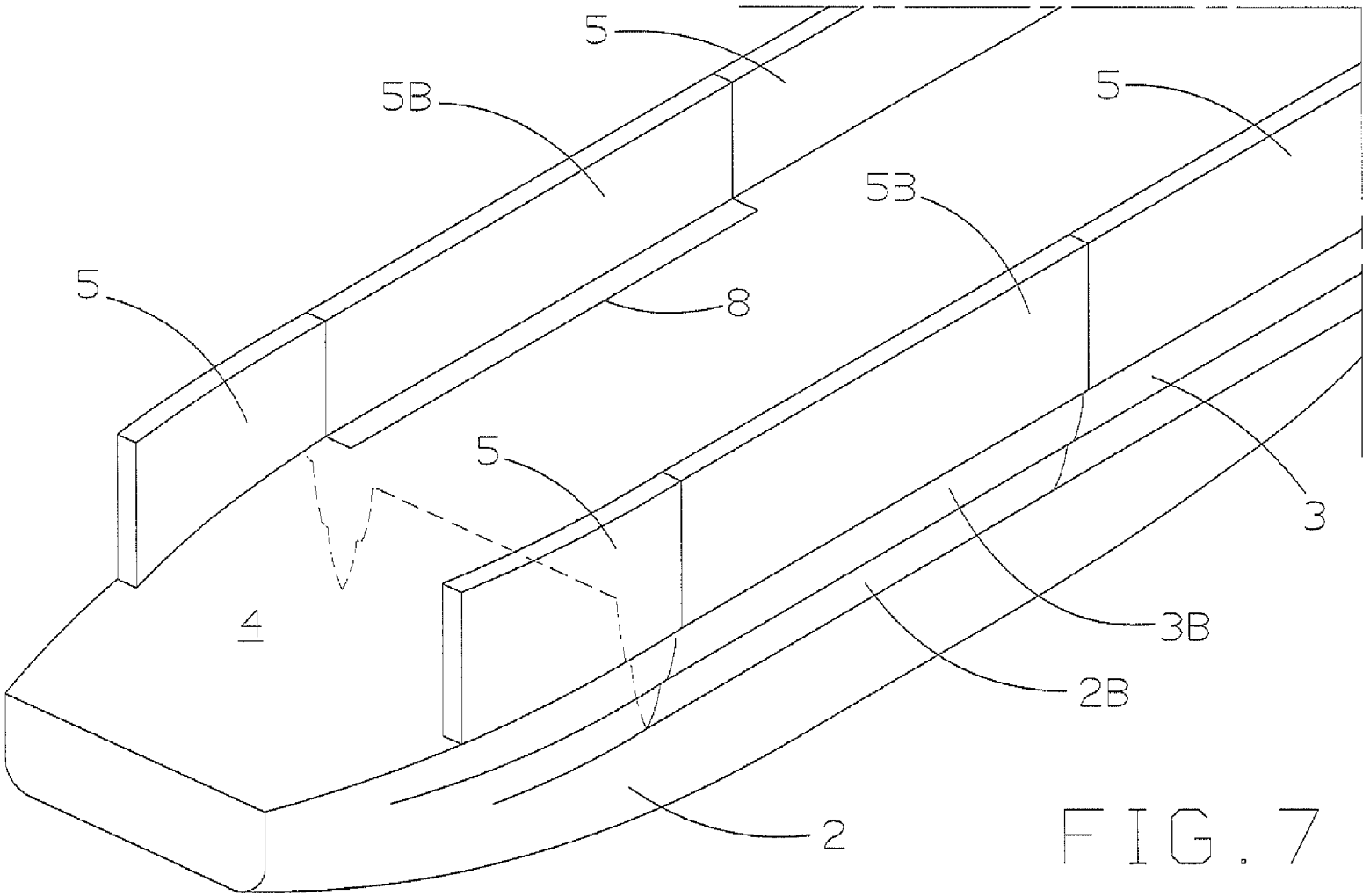
Figure 8:
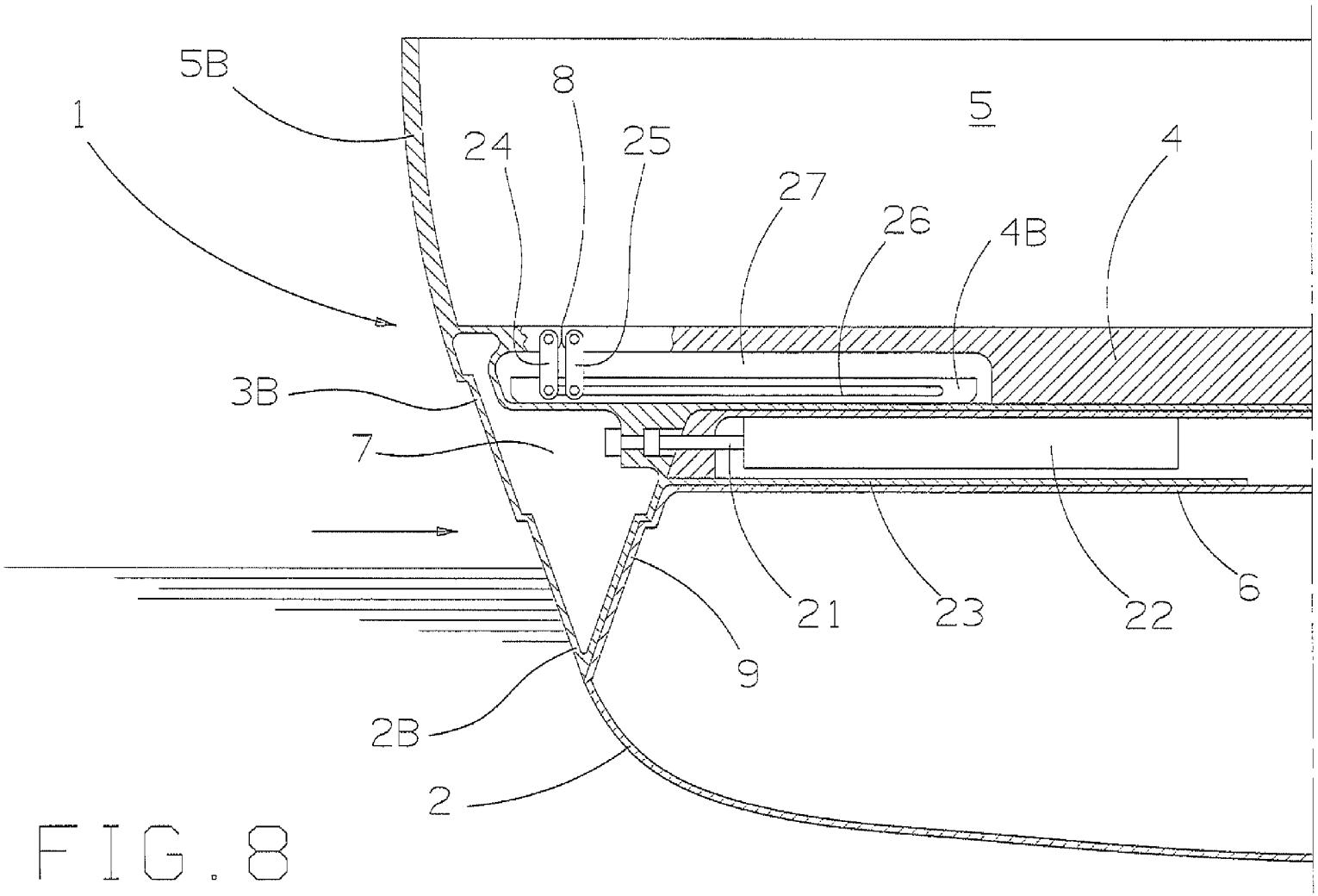
FIGS. 8, 9 and 10 show cross-sectional schematic views of a recreational vessel, provided with the hull structure according to the present invention, in a second exemplifying embodiment thereof, represented in an equivalent number of operative configurations.

FIGS. 6 to 8 show a second alternative embodiment of the hull structure according to the present invention, where 1 is used to indicate the hull, 2 is used to indicate the bottom element closed by an airtight bridge 6, 3 is used to indicate the top side, 4 is used to indicate the cover and 5 is used to indicate the plankings or gunwales.

On the two sides of the hull 1 there are respectively defined the longitudinal bottom sections 2B and the top side 3B with overlying planking sections 5B, hereinafter generally referred to as "moveable bottom elements 2B" or "ejectable bottom elements 2B", which internally delimit airtight chambers 7, insulated from the hull 1 by means of interruptions 8, but receding into the respective shape, contingently relatively housed, without projecting therefrom, in complementary compartments 9, provided on the two sides of the hull 1 (also see FIGS. 8 to 10).

The moveable bottom elements 2B are internally constrained to the apices of stems 21 of respective linear actuators 22, for example constituted by hydraulic pinions, housed between the bridge 6 and the cover 4.

Figure 9:
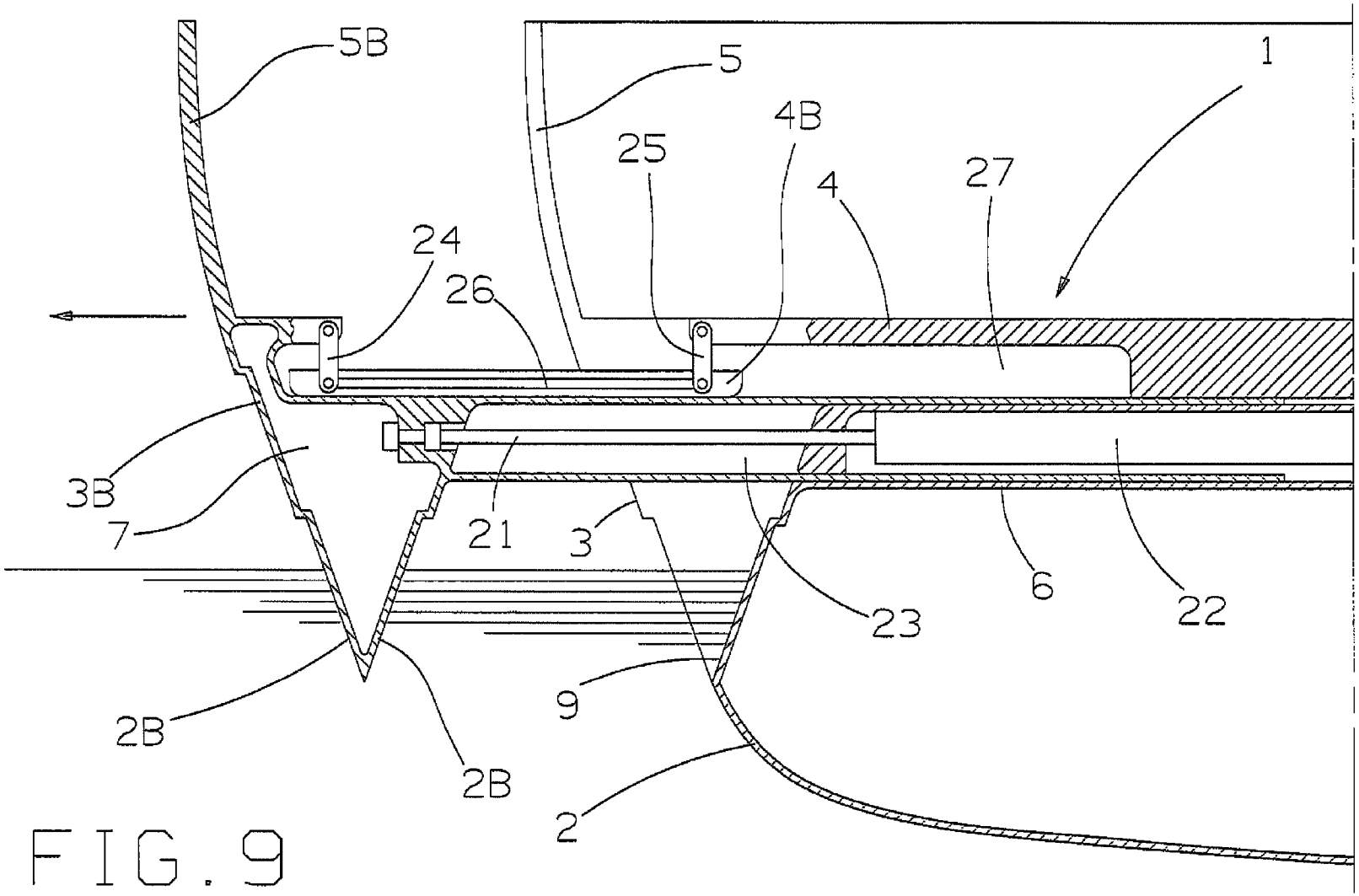
Figure 10:
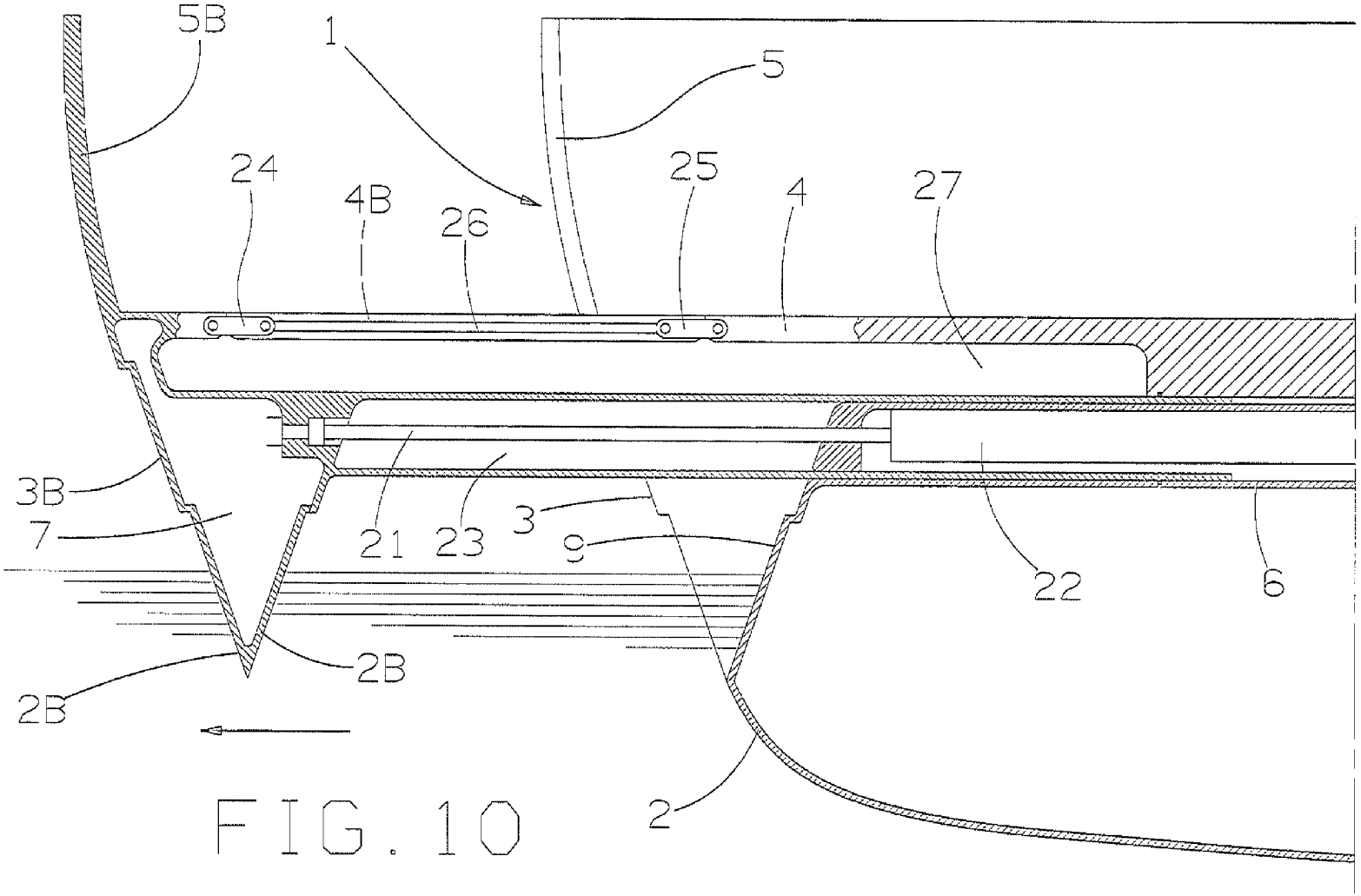

The travel of the stems 21 occurs in respective telescopic casings 23, distally integral with the moveable bottom elements 2B and proximally sliding between the bridge 6 and the cover 4 (see FIGS. 8 to 10).

At the ends of the upper interruption 8, in the thickness of the cover 4 there are constrained, on the side of the moveable bottom elements 2B, the heads of pairs of external connecting rods 24;

On the contrary, on the side of the hull 1, at the ends of the upper interruption 8, in the thickness of the cover 4, there are constrained the heads of pairs of internal connecting rods 25.

The pairs of external connecting rods 25 are hinged at the foot to a concealable panel 4B, hereinafter referred to as "cover extension" and also distinguished with reference 4B;

The pairs of internal connecting rods 24 are instead at the foot sliding in slots 26, made laterally on the sides of the cover extension panel 4B, which is housed in a compartment 27 underlying the cover 4 and comprised between the cover 4 and the telescopic casings 23.

All the structures are symmetrically conceived on the two sides of the hull.

Dynamic Description of the First Embodiment

Thus having completed the static description of the preferred embodiments of the hull structure according to the present invention, following is the dynamic description thereof, i.e. the relative operation:

the hull 1, schematically illustrated in FIG. 1, can be that of any vessel preferably a recreational vessel, which usually, when anchored on the port and when sailing, is maintained in the small configuration thereof, illustrated in FIGS. 1 and 4, i.e. with the ejectable lateral portions of the bottom element 2A, or the moveable bottom elements 2A, housed in the respective compartments 9 to form a compact hull 1 in its entirety, such as a common hull with a single bottom element.

Figure 2:
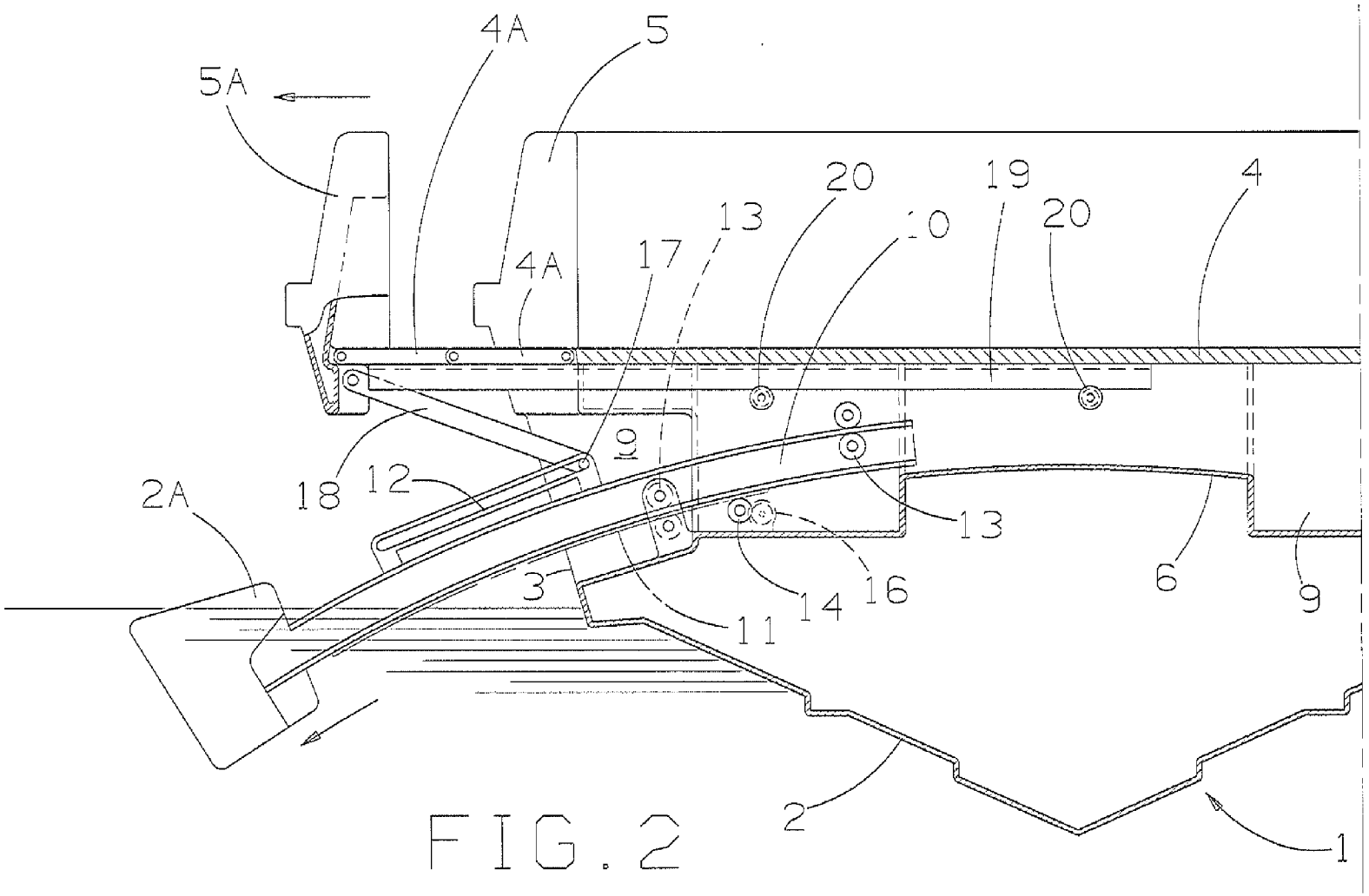

In particular conditions, especially when the vessel is anchored offshore to allow recreational activities for the occupants, hence meeting the purposes recreational vessels are intended for, by activating electric motorisations 16, with ensuing actuation of the pinions 14 on the racks 11, the curvilinear beams 10 with the relative apical portions of the bottom element 2A, or the moveable bottom elements 2A, may be ejected outwards, projecting into the water with curvilinear trajectory:

In the first step of such operation (see FIG. 2) the pins 17, at the foot of the connecting rods 18, slide in the respective symmetric pairs of slots 12 integral with the curvilinear beams 10, up to the end stops provided by the termination of the slots 12;

in such kinematic configuration the continuation of the ejection of the curvilinear beams 10 imparts and transfers, by means of the connecting rods 18, a projection movement outwards the overlying ejectable portions of plankings 5A and, therewith, to the rectilinear beams 19, which are dragged outside sliding on the respective guide rollers 20;

at the same time, the bellow panel 4A diverges and extends on the rectilinear beams 19 thus extracted, which thus provide support for local portions 4A for widening the cover 4, or cover extensions 4A, for the contingent requirements greater space for the occupants of the vessel.

At the end of the previously described excursion, the moveable bottom elements 2A are in the position of maximum projection outside the hull 1, as illustrated in FIG. 1, serving as floating balances 2A of the overlying maximum cantilevered extension of the bridge 4.

Figure 3:
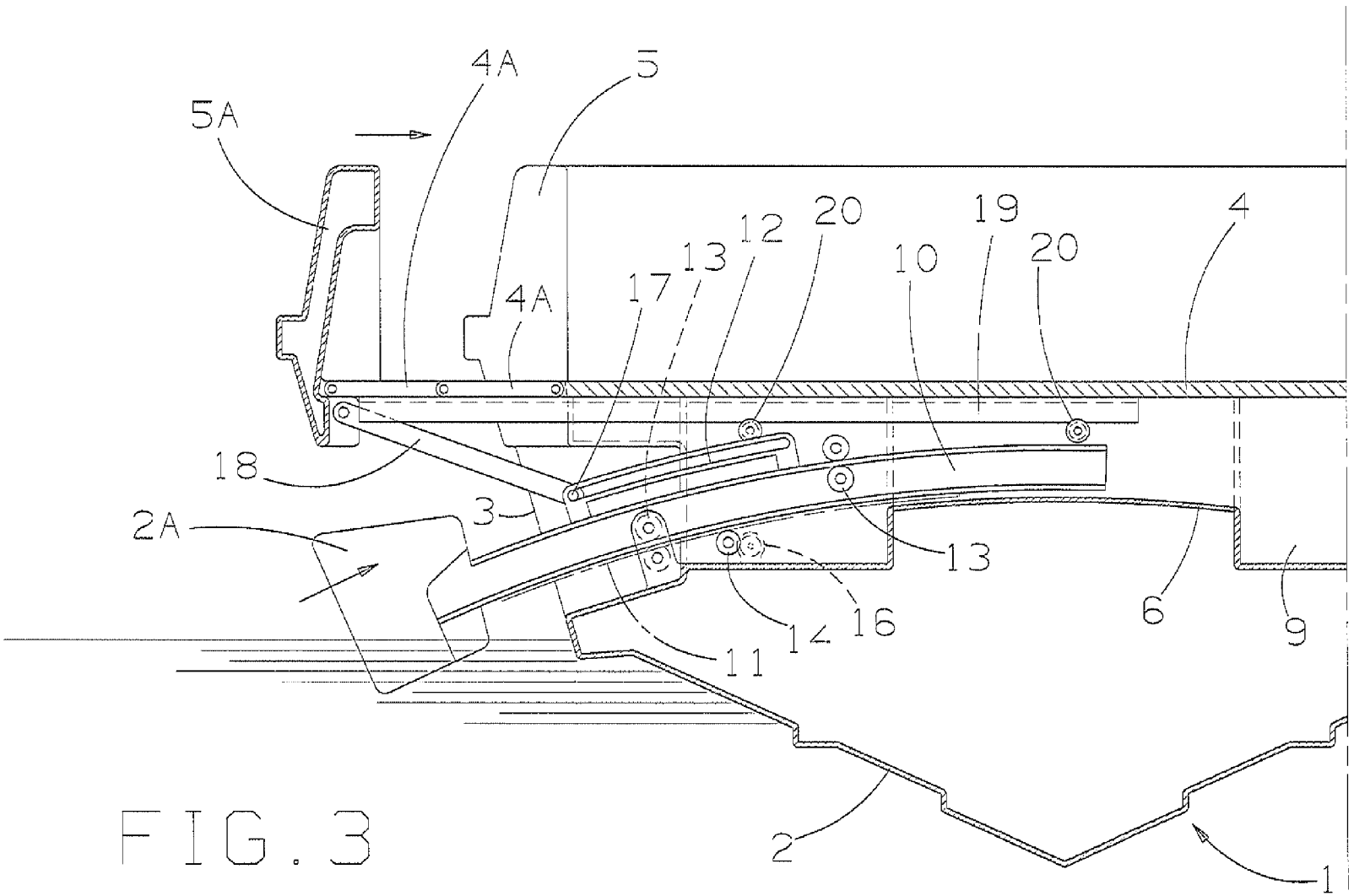

On the contrary, retracting the curvilinear beams 10, in the first step of such retraction, the pins 17, at the foot of the connecting rods 18, slide in the respective symmetric pairs of slots 12 integral with the curvilinear beams 10, up to the end stop provided by the termination of the slots 12 (see FIG. 3), thus attaining a more approached position of the moveable bottom elements 2A to the hull 1, contingently to the need; for example, in order not to interfere when adjacent to another vessel but still maintaining the cover 4 extended with the cover extensions 4A completely extended, in the same functional manner aimed at obtaining better habitability.

The operation of retracting the curvilinear beams 10, with the recession of the moveable bottom elements 2A into the small shape of the hull and acquisition of the correct sailing trim can be performed or completed before raising the anchor.

All this can be achieved under complete safe operating conditions of the vessel given that all mechanisms and controls are positioned above the airtight bridge 6 of the hull 1.

Dynamic Description of the Second Embodiment

Regarding the second embodiment, the compact configuration of the hull 1, during sailing and normal mooring, is illustrated in FIGS. 7 and 8;

in this alternative embodiment the relative operation provides for that in the previously mentioned use conditions, when the vessel is anchored offshore to allow recreational activities for the occupants, by actuating the linear actuators 22, the portions of the bottom element 2B, or the moveable bottom elements 2B, may be ejected outwards:

in such operation the interruptions 8 between the hull 1 and the moveable bottom elements 2B dilate and, at the upper part, the pairs of internal connecting rods 25 slide into the slots of the side of the panel 4B, so that, when they reach at the end stop, in combination with the action of the external connecting rods 24, they stretch it, hence, due to the lever, they raise it to the level of the cover 4 (see FIGS. 9 and 10), thus attaining local portions 4B of widening the cover 4, for the contingent needs of greater space for the occupants of the vessel.

The opposite operation, with the recession of the projections of the bottom element 2B, the top side 3B, the cover 4B and the planking 5B, or the moveable bottom elements 2B, into the small shape of the hull 1 and acquisition of the correct sailing trim can be performed before raising the anchor.

All this can be achieved under complete safe operating conditions of the vessel given that all mechanisms and controls are positioned above the airtight bridge 6 of the hull 1.

Alternative Embodiment

It is obvious that in further alternative implementations falling within the concept solution subtended to the embodiments illustrated above and claimed below, the hull structure according to the present invention can be obtained using equivalent technical and mechanical elements, or supplemented with further integrating solutions, just like all the configurations of the relative components may vary to suit the purpose.

In particular:

the structuring and movement geometry of the elements for diverging the moveable bottom elements can alternatively be any suitable for the purpose with respect to the illustrated embodiments.

The actuators for moving the structures for diverging and retracting the moveable bottom elements can alternatively be of any kind and type suitable for the purpose with respect to the illustrated embodiments.

The temporarily supplementary cover extensions or bridges can be conceived and structured in any alternative manner suitable for the purpose with respect to the illustrated embodiments, even with reference to the respective retraction criteria.

The connection means and/or articulations between the structures for diverging and retracting the moveable bottom elements and the temporarily supplementary cover extensions or bridges can be conceived and structured in any alternative manner suitable for the purpose with respect to the illustrated embodiments.

Though preferably dedicated to recreational vessels, the solution concept can actually be applied to vessels, ships, boats and crafts intended for other purposes, for example for fishing or offshore operations.

An implemented solution concept can also be conceived where the bridge is used to also achieve the widening of an overlying cabin, for example with bellow walls or somehow "telescopic"; such application could for example be applied in river vessels, similarly to road means, caravans and motor home, with rooms applied laterally.

Safety devices of any type can be provided with the aim of preventing inadvertent actuation of the means for actuating the mechanisms.

Advantages of the Invention

As clear from the previous detailed description of the preferred embodiments and with the previous reference to some variant embodiments, the hull structure according to the present invention offers advantages corresponding to the attainment of the preset objects and other objects:

actually, it integrates a functional, modular, polyvalent and inexpensive solution concept adapted to allow at least the extension of the cover with the vessel stationary, facilitating the use thereof in activities that can be carried out on board in such conditions, without contraindications in terms of the sailing characteristics without implying greater overall dimensions in the conditions where a small overall dimension of the vessel is, on the contrary, preferable.

KEY TO THE REFERENCE NUMBERS

1) hull in its entirety
2) bottom element
2A) moveable bottom elements in the first embodiment
2B) longitudinal bottom sections or moveable bottom elements in the second embodiment
3) top side
3B) top side ejectable portions in the second embodiment
4) cover
4A) bellow panel or cover extensions in the first embodiment
4B) concealable panel cover extensions in the second embodiment
5) plankings or gunwales
5A) ejectable portions of the plankings in the first embodiment
5B) ejectable portions of the plankings in the second embodiment
6) airtight bridge
7) airtight chambers of the moveable bottom elements
8) interruptions between hull and ejectable portions of bottom element
9) compartments of the hull for housing the moveable bottom elements
10) curvilinear beams in the first embodiment
11) racks of the curvilinear beams in the first embodiment
12) symmetric pairs of parallel slots of the curvilinear beams in the first embodiment
13) guide rollers of the curvilinear beams in the first embodiment
14) pinions of the racks of the curvilinear beams in the first embodiment
15) shafts of the pinions of the racks of the curvilinear beams in the first embodiment
16) electric motors in the first embodiment
17) pins at the foot of the connecting rods in the first embodiment
18) connecting rods in the first embodiment
19) rectilinear beams in the first embodiment
20) guide rollers of the rectilinear beams in the first embodiment
21) stems of the hydraulic pinions in the second embodiment
22) hydraulic pinions in the second embodiment
23) telescopic casings in the second embodiment
24) pairs of external connecting rods in the second embodiment
25) pairs of internal connecting rods in the second embodiment
26) slots made on the sides del panel of cover extension in the second embodiment
27) compartment for housing the panel of cover extension in the second embodiment

The invention claimed is:

1. A hull structure comprising:

an insulated floating section (2A, 2B; 3A, 3B) displaceable laterally by projecting actuators (10, 11, 14, 16; 21, 22) from a first trim in recessed position within a matching cavity of a hull (1) to a second trim in projecting position outside said hull (1), wherein said insulated floating section comprises movable longitudinal floating elements (2A, 2B; 3A, 3B) housed in respective matching compartments (9) provided on two sides of the hull (1), and moveable planking or gunwale sections (5A, 5B) positioned above said moveable longitudinal floating elements (2A, 2B; 3A, 3B) and connected to retractable (4A) or concealable (4B) cover portions connected to a cover (4) of said hull (1), wherein said projecting actuators (10, 11, 14, 16; 21, 22) are positioned above an airtight bridge (6) of said hull (1), said projecting actuators (10, 11, 14, 16; 21, 22) being constrained to said hull (1) and to said movable longitudinal floating elements (2A, 2B; 3A, 3B) and configured to displace said movable longitudinal floating elements (2A, 2B; 3A, 3B) from a first trim position recessed in the hull (1) to a second trim position projecting outside of the hull, and vice versa, wherein articulated pushing and drawing members comprise levers (18; 24, 25) and are apically connected to slots (12; 26) configured to move said retractable or concealable cover portions (4A; 4B) extracting and projecting said retractable or concealable cover portions (4A; 4B) laterally and to automatically displace said retractable or concealable cover portions (4A; 4B), and wherein said articulated pushing and drawing members are connected to said projecting actuators (10, 11, 14, 16; 21, 22) and support a lateral displacement of said longitudinal floating elements (2A, 2B; 3A, 3B).

2. The hull structure according to claim 1, wherein said movable planking sections (5A, 5B) comprise a folded bellow panel (4A), providing an extension connected to the cover (4), wherein the projecting actuators comprises two or more curvilinear beams (10), each distally constrained to one of said movable longitudinal floating elements (2A), and are housed between the bridge (6) and the cover (4), said beams being provided in a respective lower portion with a rack (11) and in a respective upper portion with a slotted element (12) extending longitudinally and parallel to the curvilinear beams (10), wherein the projecting actuators further comprise pinions (14) engaging said racks (11) of said curvilinear beams (10)*v* and an electric motor (16) operatively coupled to said pinions, and wherein connecting rods (18) have pins (17) at first ends that engage said slotted elements (12) of said curvilinear beams (10) and are constrained apically at second ends to a head of said moveable planking or gunwale sections (5A), said head being fixedly coupled to rectilinear beams (19) sliding beneath the cover (4).

3. The hull structure according to claim 1, wherein said movable longitudinal floating elements each comprise a lower portion (2B) and an upper portion (3B), said upper portion having the planking sections (5B) overhanging thereon, said floating elements being internally delimited by airtight chambers (6) insulated from the hull (1), said movable longitudinal floating elements being each configured to recede into a respective matching cavity defined adjacently to an airtight bridge provided on a side of the hull (1), wherein stems (21) of additional linear actuators (22) are housed between the airtight bridge (6) and the cover (4) and are apically constrained to said movable longitudinal floating elements, wherein telescopic casings (23) enclosing said stems (21) are distally integral with said movable longitudinal floating elements and are proximally sliding between the bridge (6) and the cover (4), said telescopic casings (23) being configured to be extracted and retracted automatically and simultaneously with a displacement of said lower portion (2B) and upper portion (3B), and wherein said concealable cover portions (4B) are housed in compartments (27) beneath the cover (4), further comprising a system (24, 25, 26) configured to move said concealable cover portions (4B) to a coplanar level with the cover (4) when extracted, said system comprising pairs of connecting rods (24, 25) hinged to the cover (4) and sliding on said concealable cover portions (4B).

* * * * *